US007138591B2

(12) United States Patent
Miwa et al.

(10) Patent No.: US 7,138,591 B2
(45) Date of Patent: Nov. 21, 2006

(54) ELECTRIC PART WITH ILLUMINATION HAVING AN ILLUMINATING MEMBER MOVABLE INTEGRALLY WITH AN OPERATING MEMBER AND BEING SUPERIOR IN ASSEMBLEABILITY

(75) Inventors: Toshitaka Miwa, Miyagi-ken (JP); Shinji Komatsu, Miyagi-ken (JP); Fumito Kajiwara, Miyagi-ken (JP); Mikio Sasaki, Miyagi-ken (JP); Dohyung Kim, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/200,445

(22) Filed: Aug. 9, 2005

(65) Prior Publication Data

US 2006/0032732 A1 Feb. 16, 2006

(30) Foreign Application Priority Data

Aug. 10, 2004 (JP) ..... 2004-233346
Nov. 29, 2004 (JP) ..... 2004-344418

(51) Int. Cl.
*H01H 9/00* (2006.01)

(52) U.S. Cl. ..... 200/313; 200/5 R; 200/310

(58) Field of Classification Search ..... 200/310–317, 200/5 R
See application file for complete search history.

(56) References Cited

U.S. PATENT DOCUMENTS

| | | | | |
|---|---|---|---|---|
| 4,868,354 | A | 9/1989 | Ray et al. | |
| 4,975,547 | A | 12/1990 | Nakayama et al. | |
| 5,813,519 | A | 9/1998 | Gotoh | |
| 6,155,691 | A * | 12/2000 | Miyasaka | 362/30 |
| 6,420,667 | B1 * | 7/2002 | Miwa et al. | 200/4 |
| 6,515,242 | B1 * | 2/2003 | Takatsuki | 200/6 A |

FOREIGN PATENT DOCUMENTS

| | | |
|---|---|---|
| JP | 1-60806 | 11/1989 |
| JP | 9-102234 | 4/1997 |
| JP | 9-226456 | 9/1997 |

* cited by examiner

*Primary Examiner*—Richard K. Lee
(74) *Attorney, Agent, or Firm*—Brinks Hofer Gilson & Lione

(57) ABSTRACT

In order to provide an electric part with illumination in which unevenness of illumination is eliminated, the illumination efficiency is improved, and good assembleability is achieved, an illumination member is retained on a base, and the base is retained by an operating member and a movable contact for electrically connecting an electrode on the illuminating member and a power feed pattern is retained on the operating member.

10 Claims, 10 Drawing Sheets

ELECTRIC PART WITH ILLUMINATION HAVING AN ILLUMINATING MEMBER MOVABLE INTEGRALLY WITH AN OPERATING MEMBER AND BEING SUPERIOR IN ASSEMBLEABILITY

This application claims the benefit of priority to Japanese Patent Application No. 2004-233346 filed on Aug. 10, 2004 and 2004-344418 filed on Nov. 29, 2004, herein incorporated by reference.

BACKGROUND OF THE INVENTION

1. Field of the Invention

The present invention relates to an electric part with illumination and, more specifically, to an electric part with illumination which can introduce light from an illuminating member to illuminate an operating member.

2. Description of the Related Art

As an electric part with illumination used for vehicles or the like, structures disclosed in Japanese Unexamined Patent Application Publication No. 9-102234 (hereinafter, referred to as a prior art) and Japanese Unexamined Utility Model Registration Application Publication No. 1-160806 (hereinafter, referred to as another prior art) are known, and the prior art is shown in FIG. 12 to FIG. 15, and another prior art is shown in FIG. 16.

The prior art will be described first. In FIG. 12 to FIG. 15, reference numeral 200 designates an upper case of a case, and reference numeral 210 designates a lower case (or a holder) of the case. An inner partition plate 211 of the lower case 210 includes terminals 212 fixed thereto, and the inner partition plate 211 also includes a light source 220 detachably mounted thereto.

Reference numeral 230 designates an inner case which is a separate member from the upper case 200 and the lower case 210, and reference numeral 240 designates an insulative circuit board. The circuit board 240 is formed of, for example, a printed circuit board (P.C.B). An upper surface of the circuit board 240 is provided with an electrically-conductive conductor by printing.

Reference numeral 250 designates a slider for a four-direction switch. The four-direction slider 250 is disposed so as to be capable of sliding in four directions in the upper case 200 between the inner case 230 and the circuit board 240.

Reference numeral 260 designates an actuator of the four-direction switch. The actuator 260 is supported by the case (the upper case 200, the lower case 210, and the inner case 230) so as to be capable of tilting in four directions for sliding the four-direction slider 250 in four directions.

A lower surface of an engaging portion 261 of the actuator 260 opposes the single light source 220 via a through hole 241 of a small square shape formed on the circuit board 240. The actuator 260 also constitutes a transmitting member for allowing light from the single light source 220 to be transmitted to a mark 281 on a four-direction switching knob 280 described later.

Reference numeral 280 designates the switching knob of four-direction switch. The four-direction switching knob 280 is fixedly fitted to an upper end of a shaft portion 262 of the actuator 260. Reference numeral 290 designates an automatic restoration spring for the four-direction switch.

Reference numeral 300 designates a slider for two-direction switch. The two-direction slider 300 includes an operating rod 301 at a substantially center of an upper surface thereof so as to project integrally upward in the vertical direction. A lower surface of the two-direction slider 300 is integrally provided with four hollow cylindrical storages 302 opening on the bottom sides thereof. The two-direction slider 300 is arranged in the upper case 200 between the upper case 200 and the upper surface of the circuit boards 240 so as to be capable of sliding in the linear direction.

The lower surface of the two-direction slider 300 opposes a conductor 310, described later, through the small rectangular through hole 241 of the circuit board 240. The two-direction slider 300 constitutes a part of two-direction switch, and also constitutes a transmitting member for allowing light from the single light source 220 to be transmitted to a mark 321 of a two-direction switching knob 320 via the light guiding member 310.

The two-direction switching knob 320 is fixedly fitted to an upper end of the operating rod 301 of the two-direction slider 300. The two-direction switching knob 320 includes, for example, a light-transmitting synthetic resin (acrylate resin (PMMA: polymethylmethacrylate)) and formed substantially into an L-shape. The mark 321 having light transmitting property is provided at substantially a center of a top of the two-direction switching knob 320. The above-described mark 321 is illuminated by light from the single light source 220, which is guided by the light guiding member 310, described later, and transmitted through the two-direction slider 300 as the transmitting member.

Reference numerals 350 and 360 designate ball and spring as s switching mechanism. The spring 360 is stored on one side surface of the two-direction slider 300 in an compressed state, while the ball 350 is provided between the spring 360 in the compressed state and s switching groove (not shown) provided on an inner surface of the upper case 200. The switching mechanism retains a state in which the two-direction switching knob 320 and the two-direction slider 300 are positioned at a neutral position, a first position, and a second position, and function to give a tactile feedback of switching operation of the two-direction switching knob 320 and the two-direction slider 300.

Reference numeral 370 designates a contact of the two-direction switch. The two-direction contact 370 includes four coil springs 371 for contact points, two plate contacts 372, and four contact point balls 373. The four contact balls 373 of the two-direction contact 370 are constantly in press-contact with the circuit board 240 via the plate contacts 372 by a coil spring 371, and is moved in two linear directions on the circuit board 220 via the two-direction slider 300 by two-direction operation of the two-direction switching knob 320 into contact with the fixed contact point of the circuit board 240, whereby a first circuit and a second circuit are formed respectively.

Reference numeral 310 is the light guiding member. The light guiding member 310 is formed of transparent synthetic resin (acrylate resin) of light transmitting property, and causes the mark 321 of the two-direction switching knob 320 to be illuminated by light from the single light source 220 via the two-direction slider 300. The light guiding member 310 is stored in a space between an upper surface of the inner partition plate 211 of the lower case 210 and a lower surface of the electric circuit board 240, and includes a light receiving surface 312 provided at one end of a light guiding member 311 and formed into a L-shape opposing to the single light source 220, and a rectangular light projecting member 313 provided at the other end of the light guiding member 311, and fitted into a small rectangular hole 241 of the circuit board 240 so as to oppose the lower surface of the two-direction slider 300.

The electric part with illumination in the prior art is configured as described above, and the operation thereof will be described below. In the operation of the two-direction switch, when the two-direction switching knob 320 located at the neutral position is moved toward the left (a dashed line in FIG. 14) or toward the right (a solid line in FIG. 14), the moving force of the two-direction switching knob 320 is transmitted to the two-direction slider 300, and the two-direction slider 300 slides in the same direction between the upper casing 200 and the circuit board 240, whereby the two-direction slider 300 is located at the first position or the second position.

The electric part with illumination in the prior art is configured in such a manner that the single light source 220 is illuminated, partial light from the single light source 220 passes through the small square through hole 241 of the electric circuit board 240 and advances from the lower surface to the upper surface of the transparent actuator 260, and reaches the four-direction marks 281 via the four-direction switching knob 280 to illuminate the four-direction mark 281. On the other hand, the remaining light passes through the light guiding member 311 from the light receiving surface and reaches the light projecting member 313, then, from the light projecting member 313, advances from the lower surface to the upper surface of the transparent two-direction slider 300, and reaches the two-direction mark 321 via the two-direction switching knob 320 to illuminate the two-direction mark 321.

Subsequently, another prior art will be described. As shown in FIG. 16, reference numeral 500 designates an illuminating section such as a light-emitting diode, reference numeral 501 designates an operating element (knob) having the illuminating section 500 inserted therein and retained at an upper end thereof, and reference numeral 502 designates a power feed sliding member provided on a lower surface of the operating element 501.

Then, the operating element 501, although not shown, is slidably stored in an enclosure with an upper portion of the operating element 501 projected therefrom. The power feed sliding member 502 of the operating element 501 slides on the fixed contact pattern formed on the bottom surface in the enclosure and is supplied with power.

In the slide-type electric part with illumination in the prior art as described above, since the longitudinal direction of the rectangular light projecting member 313 of the light guiding member 310 opposing the lower surface of the two-direction slider 300 coincides with the sliding direction of the two-direction slider 300, as shown in FIG. 14, even when the two-direction switching knob 320 is switched linearly to the left and right, the rectangular light projecting member 313 of the light conducting member 310 constantly opposes the lower surface of the two-direction slider 300 and supplies light from the single light source 220 to the two-direction switching knob 320 via the two-direction slider 300. Consequently, even when the sliding switch mechanism is used as the two-direction switch, the mark 321 of the two-direction switching knob 320 is constantly illuminated.

In the prior art, since the illumination is established over the entire area of the sliding movement of the two-direction slider 300, it is necessary to illuminate the unnecessary portion, and hence efficiency may be lowered. Also, since the two-direction slider 300 moves to the center, left and right positions, the distance from the light source 220 varies, and hence there was a problem that unevenness of illumination is generated.

Also, assembleability of the contact 370 of the two-direction switch was not good since the four coil springs 371, the two plate contacts 372, and the four contact point balls 373 are stored in a storage 302 formed on a lower surface of the slider 300 in a separate state.

The above-described problem does not exist in the slide-type electric parts in the arrangement shown in FIG. 16, since the illuminating section 500 is retained in the operating element 501 and is connected to the power feed patterns provided on the enclosure (fixed portion). However, in the arrangement of FIG. 16, there are problems that the cost is high since the illuminating section 500 is inserted into an upper portion of the operating element 501, the workability is low since the LED is inserted into the operating element 501 when assembling the LED as the illuminating section 500.

SUMMARY OF THE INVENTION

Accordingly, it is an object of the invention to provide an electric part with illumination in which the illuminating member can be mounted easily to the operating member, unevenness of illumination is not generated even when the operating member is moved, and good assembleability is ensured.

In order to solve the above-described problems, an electric part with illumination according to the invention includes an operating member being movably retained and having an illuminating section thereon; an illuminating member moving integrally with the operating member and illuminating the illuminating section; a fixed portion having power feed patterns which can feed power to the light illuminating member; a movable contact moving integrally with the operating member and having a sliding strip, the sliding strip having a connecting portion to be electrically connected to an electrode of the illuminating member and a contact point sliding on the power feed patterns; and a base retaining the illuminating member and being retained by the operating member.

Preferably, the illuminating member is disposed on a surface of the base opposing the operating member and the sliding strip is disposed on the opposite surface thereof.

Preferably, the movable contact is integrally formed on the base. Preferably, the movable contact includes a proximal portion formed with the connecting portion, and part of the proximal portion thereof is embedded in the base, and portion exposed from the base is used as the connecting portion. Preferably, the operating member and the base are formed of different materials.

Preferably, the base is snap-fitted to the operating member so as to be disconnected therefrom. Preferably, the movable contact includes a pair of movable contacts connected to an anode side and a cathode side of the electrode of the illuminating member and insulated from each other. The pair of the movable contacts are integrally formed from a single metal sheet by embedding in the base and then cutting a cutting portion which connects the pair of the movable contacts.

Preferably, the proximal portion is formed with the cutting portion, and the base is formed with a cutting hole which enables cutting of the cutting portion after having embedded. Preferably, the base is formed with a conductive pattern which connects a portion retaining the illuminating member and the connecting portion with respect to the movable contact, the illuminating member and the movable point are electrically connected, and the conductive pattern and the movable contacts are brought into resilient contact. Preferably, the movable contact is inserted and retained in a storage provided on the operating member, and an insertion portion is formed on a side surface of the operating member extending in the direction orthogonal to the inserting direction of the movable contacts for allowing the base to be inserted therein.

DESCRIPTION OF THE PREFERRED EMBODIMENTS

Figure 1:
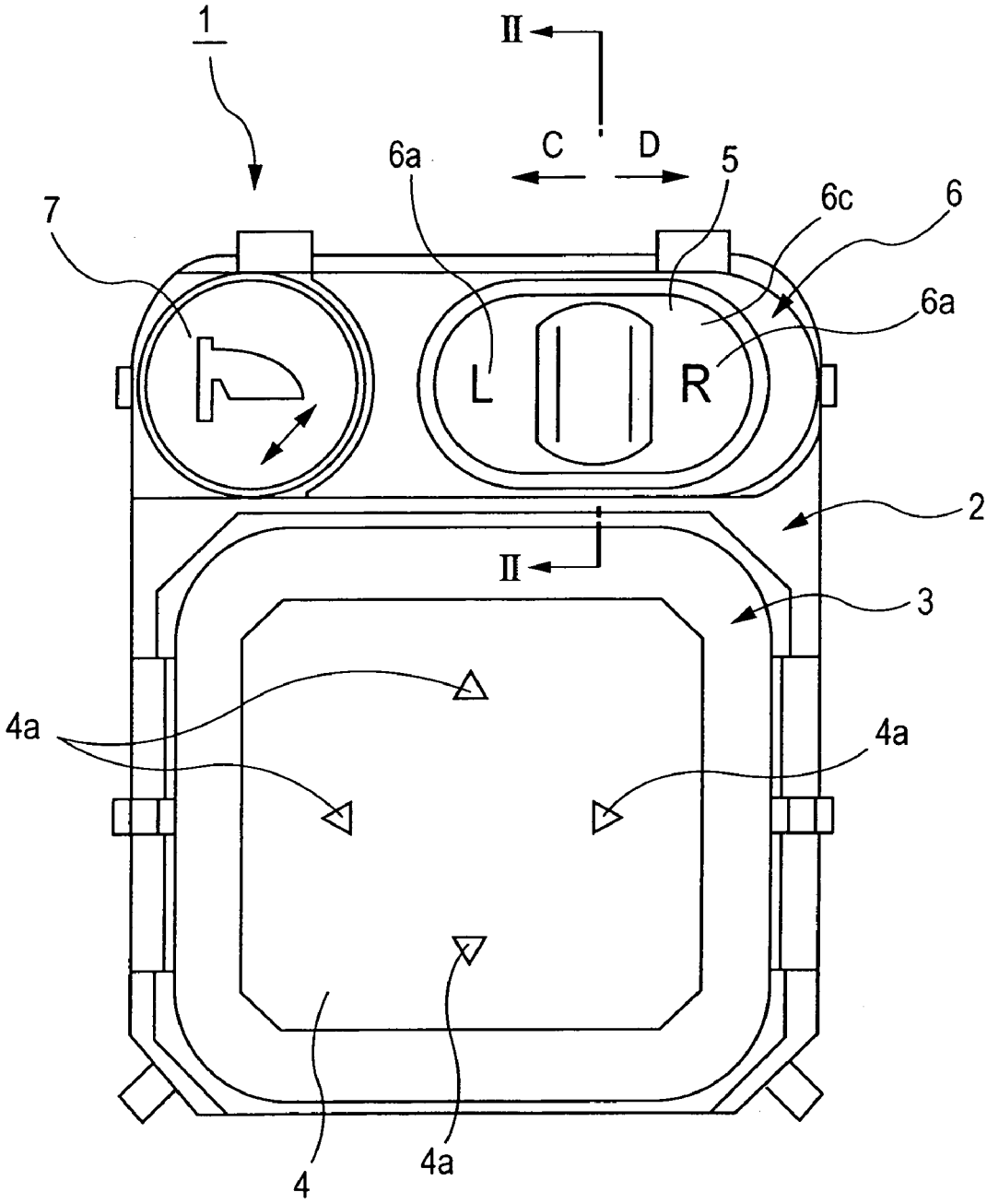
FIG. 1 is a plan view of a slide-type electric part with illumination according to a first embodiment of the invention.
Figure 2:
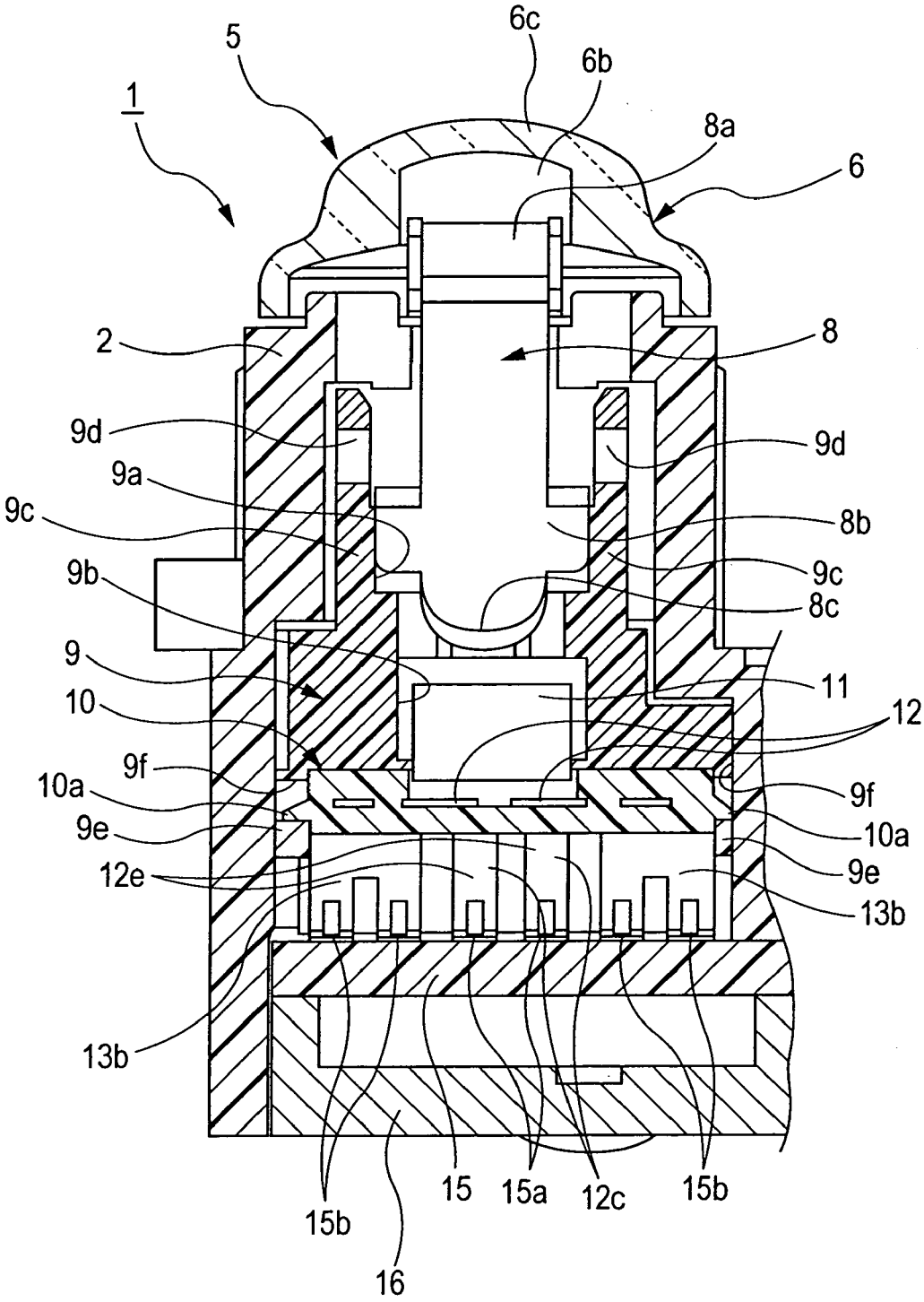
FIG. 2 is a cross-sectional view taken along a line II—II in FIG. 1.
Figure 3:
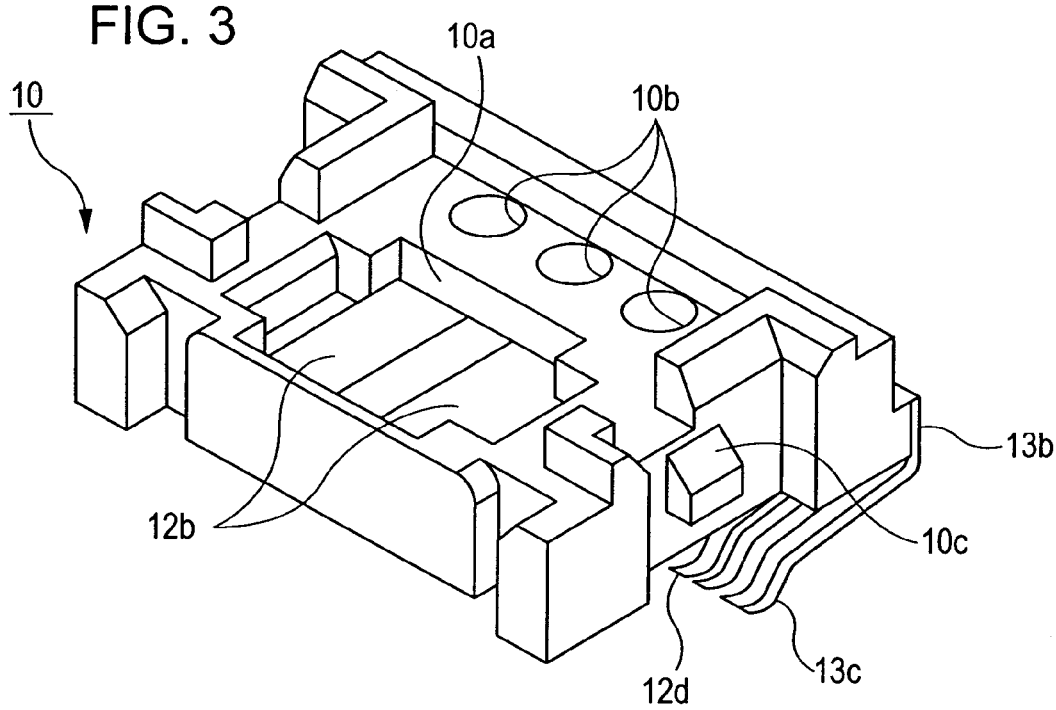
FIG. 3 is a perspective view of a base in FIG. 2.
Figure 4:
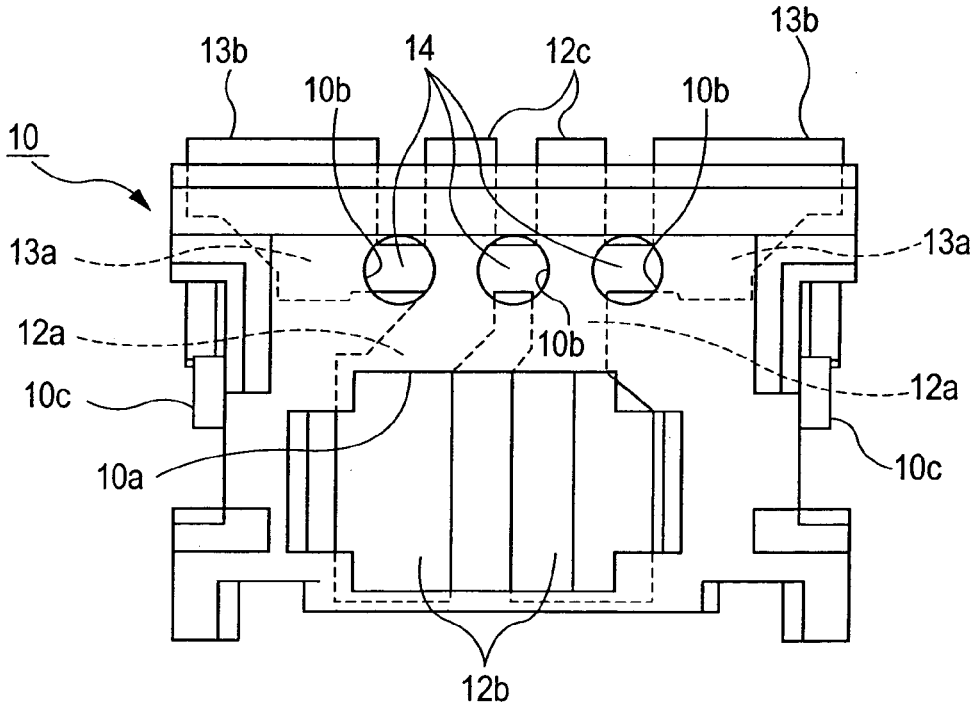
FIG. 4 is a plan view explaining a method of manufacturing the base in FIG. 2.

As a first embodiment of an electric part with illumination according to the invention, a case in which the invention is applied to a slide switch for driving a door mirror used in a vehicle will be described based on the drawings. FIG. 1 is a plan view of the electric part with illumination according to the invention; FIG. 2 is a cross-sectional view taken along a line 2—2 in FIG. 1; FIG. 3 is a perspective view of a base according to the invention; and FIG. 4 is a plan view explaining a method of manufacturing of the base according to the invention.

An electric part 1 with illumination of the invention is surrounded by an upper case 2, the outer periphery thereof is formed of resin material as shown in FIG. 1, and a four-direction switch 3 is disposed on the lower side of the upper case 2 in the drawing. The four-direction switch 3 includes a switching knob 4 having a substantially square contour and being formed of light transmitting resin material such as acrylic. Formed on a surface of the switching knob 4 are marks 4*a* showing, for example, operating directions at four positions on top, bottom, left and right thereof. Portion other than the marks 4*a* is coated with opaque coating, so that the marks 4*a* are illuminated by light from a light source, not shown.

Then, a four-direction switch circuit is adapted to be able to switch by pressing the switching knob 4 of the part formed with, for example, the marks 4*a*.

A two-direction switch 5 which is operated by sliding movement is disposed on the upper side of the upper case 2 shown in FIG. 1, and the two-direction switch 5 has a substantially oval shape in contour, and includes an operating knob 6*c* formed of light transmitting resin material such as acrylic. The operating knob 6*c* is adapted to be capable of switching the two-direction switch circuit by being slid leftward indicated by an arrow C in the drawing and rightward indicated by an arrow D therein.

The operating knob 6*c* is formed with two display marks 6*a*, 6*a* (illuminating section) indicated, for example, by L and R, and the portion other than the display marks 6*a*, 6*a* is coated with opaque coating, whereby the display marks 6*a*, 6*a* emerge when the operating knob 6*c* is illuminated by light emitted from the illuminating member 11, described later.

The upper case 2 on the left side of the operating knob 6*c* in the drawing is formed with an operating switch 7 having a design pattern indicating the state of storage and usage of a side mirror which is used for positioning the side mirror to a stored position or a position for use.

The two-direction switch 5 is used for specifying the mirror to be operated between the left mirror and the right mirror, the operation switch 7 is used for specifying whether the side mirror is to be stored or to be used, and the four-direction switch 3 is used for adjusting the angle.

The two-direction switch 5 mainly includes an operating member 6, a base 10 retained by the operating member 6, an illuminating member 11 placed on the base 10, movable contacts 12 retained in a state of being embedded in the base 10 and connected to the illuminating member 11, and power feed patterns 15*a* on which the movable contacts 12 slide, as shown in FIG. 2.

The operating member 6 includes the operating knob 6*c*, a light guiding member 8, and a movable member 9, and a distal end of the light guiding member 8 is retained by a light guiding member retaining portion 6*b* formed on the lower side of the operating knob 6*c*.

The light guiding member 8 has a square column shape and is formed of light transmitting resin material such as acrylic, and a distal end 8*a* on the upper side in FIG. 2 is retained by the light guiding member retaining portion 6*b* of the operating knob 6*c*, and a wide portion 8*b* on the lower side thereof is fitted and supported in a fitting groove 9*a* of the movable member 9. The light guiding member 8 is formed with an incident portion 8*c* formed into an arcuate shape at a lower end thereof, so that light can be incident efficiently into the light guiding member 8 when light of the illuminating member 11 described later is irradiated on the incident portion 8*c*.

The movable member 9 is formed of synthetic resin such as polyacetal and is formed with a light source insertion portion 9*b* so as to continue from a lower portion of the fitting groove 9*a*, and the illuminating member 11, described later, is positioned in the light source insertion portion 9*b*. Formed on first side walls 9*c* opposing to each other with the intermediary of the fitting groove 9*a* of the movable member 9 are engaging holes 9*d* with which snap legs (not shown) formed on the operating knob 6*c* can be snap-fitted, and by snap-fitting the snap legs to the engaging holes 9*d*, the operating knob 6*c* and the movable member 9 can be integrated, so that when the operating knob 6*c* is operated in the direction C and D indicated by the arrows, the movable member 9 is also moved in the same direction.

Formed on the lower side of the movable member 9 shown in FIG. 2 is a pair of second side walls 9*e* opposing to each other with the intermediary of a predetermined clearance, and the second side walls 9*e* are formed with second engaging holes 9*f*.

Disposed in the clearance interposed between the pair of second side walls 9*e* opposed to each other is the base 10 having a predetermined thickness. The base 10 is formed of synthetic resin such as PBT containing glass, and is formed with a square recess 10*a* as shown in FIG. 3 and FIG. 4, and three cutting holes 10*b* are formed on the farther side from the square recess 10*a* in the drawing.

The movable member 9 includes a ball (not shown) which resiliently urges against an inner surface of the upper case 2 inserted therein, and the ball generates a feeling of click at three positions of the movable member 9 including a neutral position, a first position reached when it is slid in the direction indicated by an arrow C, and a second position reached when it is slid in the direction indicated by an arrow D.

The base 10 is disposed in parallel with a plate surface of the fixing member 15, the operating member 6 is formed so as to project in the vertical direction with respect to the base 10, and the operating knob 6*c* extending in the moving direction is formed at the distal end thereof.

The upper case 2 is formed with recesses on the inner surface thereof at positions corresponding to the three positions so as to allow the balls to engage to generate a feeling of click.

The base 10 is formed with engaging claws 10*c* from the left and right sides thereof in the drawing so as to project therefrom, whereby the moving member 9 and the base 10 are integrated by snap-fitting the engagement claws 10*c* with the second engaging holes 9*f* of the moving member 9.

The illuminating member 11 formed of a chip-type light-emitting diode or the like can be positioned in the square recess 10*a* on the base member 10, and proximal portions 12*a* of a pair of the first movable contacts 12, 12 are partly embedded and integrated in part of the base 10 around the square recess 10*a* by insert molding or the like.

The first movable contacts 12 are formed by bending a metal plate having resiliency and includes sliding strips 12*e* each having a contact portion 12*d* which can come into sliding contact with power feed patterns 15*a*, described later, and an arm portion 12*c*.

The first movable contacts 12 are embedded at the proximal portions 12*a* thereof in the base 10, and include connecting portions 12*b* which are part of the proximal portions 12*a* exposed from a bottom surface of the square recess 10*a*, and the arm portions 12*c* are formed on the farther side of the base 10 in the drawing by being extended from the proximal portions 12*a*, the arm portions 12*c* are bent toward a back surface of the base 10, and the contact portions 12*d* which can come into sliding contact with the power feed patterns 15*a*, described later, are formed at the distal ends of the bent portions.

The pair of first movable contacts 12 are adapted in such a manner that the electrode (not shown) on the anode side of the illuminating member 11 positioned in the square recess 10*a* and the electrode (not shown) on the cathode side can be electrically connected to one of the connecting portions 12*b* thereof and the other connecting portion 12*b* respectively via soldering or the like. In other words, the illuminating member 11 is adapted to be illuminated by supplying power to the illuminating member 11 via the first movable contacts 12.

The base member 10 includes second movable contacts 13 having sliding strips being formed of the same material as the first movable contacts 12 and each including a contact point 13*c* and an arm portion 13*b*, which are embedded and integrated in the vicinity of the cutting holes 10*b* outside the pair of first movable contacts 12.

The second movable contacts 13 are embedded at the proximal portions 13*a* thereof in the base 10, and include the arm portions 13*b* extending from the proximal portions 12*a* behind the base 10 in the drawing. The arm portions 13*b* are bent toward the back surface of the base 10 as in the case of the first movable contacts 12, and is formed with the contact portions 13*c* which can come into sliding contact with a two-direction switch pattern 15*b* described later at the distal ends of the bent portions.

The second movable contacts 13 are adapted to switch the circuit of the two-direction switch 5 corresponding to the sliding movement of the operating member 6 in the direction indicated by the arrow C or in the direction indicated by the arrow D.

The first and second movable contacts 12, 13 embedded in the base 10 are formed by punching a single metal plate by press work into an integral member connected by cutting portions 14 as shown in FIG. 4, and are adapted to be capable of being cut and separated at the cutting portions 14 through the cutting holes 10*b* after having embedded into the base 10 by insertion or the like. Therefore, the first and second movable points 12, 13 are integrated by being embedded in the base 10, and are insulated from each other.

Disposed on the lower side in the drawing opposing to the base 10 at a predetermined clearance therefrom is a fixed member 15 formed of a printed board, and the power feed patterns 15*a* are formed on a portion of the upper surface of the fixed member 15 with which the first movable contacts 12 come into sliding contact, so that the power can be fed to the illuminating member 11 via the first movable contacts 12.

Formed also on the upper surface of the fixed member 15 outside the power feeding pattern 15*a* is the two-direction switch pattern 15*b* with which the second movable contacts 13 can come into sliding contact.

The lower portion of the upper case 2 is opened, and a lower case 16 is secured to the opened portion with snap-fitting or press-fitting, whereby the opening at the lower portion of the upper case 2 is tightly closed. The fixed member 15 is adapted to be fixed inside the upper case 2 by the lower case 16.

The operation of the electric part 1 with illumination of the invention will be described. For example, when the engine of the vehicle is activated and the headlight is turned on, the illuminating member 11 is in a state of being fed with power from the power feed patterns 15*a* via the first movable contacts 12, thereby constantly being illuminated. Therefore, the display mark 6*a* is also constantly illuminated irrespective of the operated position of the operating knob 6*c*.

For example, when the operating knob 6*c* of the two-direction switch 5 at the neutral position is slid and moved in the direction indicated by the arrow C on the side of the display mark L, the circuit of the two-direction switch 5 is switched to establish the first circuit.

When the switching knob 4 of the four-direction switch 3 is tilted in a state in which the two-direction switch 5 establishes the first circuit, the side mirror on the left side can be operated in the desired direction.

When the operating knob 6*c* of the two-direction switch 5 is slid and moved in the direction indicated by the arrow D on the side of the display mark R, the circuit of the two-direction switch 5 is switched to establish the second circuit.

When the switching knob 4 of the four-direction switch 3 is tilted in a state in which the second-direction switch 5 establishes the second circuit, the side mirror on the right side can be operated in the desired direction.

For example, in a state in which the second-direction switch 5 establishes the first circuit, the side mirror on the left side is tilted upward when the switching knob 4 of the four-direction switch 3 is tilted upward, the side mirror on the left side is tilted downward when the switching knob 4 of the four-direction switch 3 is tilted downward, the side mirror on the left side tilts leftward when the switching knob 4 is tilted leftward, and the side mirror on the left side is tilted rightward when the switching knob 4 is tilted rightward.

When the operating knob 6*c* of the two-direction switch 5 is at the neutral position, the side mirror is not tilted irrespective of direction of tilting operation of the switching knob 4 of the four-direction switch 3, whereby the possibility of erroneous operation is eliminated.

In this embodiment, since the assembly is achieved simply by placing the chip-type illuminating member 11 on the base 10, connecting the electrode of the illuminating member 11 to the first movable contact 12, and mounting the same to the movable member 9, the assembly can be achieved easily without giving any thermal damage to the illuminating member Although description has been made about the case in which the movable member 9 is slid and moved in the embodiment of the invention, it is also possible to support the movable member 9 rotatably on the upper case 2, and adapt the operating member 6 to be operated by rotary motion.

Although description has been made about the mode in which the first movable contact 12 is formed by punching a single metal plate, it is also possible to form the arm portion 12*c* separately from the proximal portion 12*a* and attach the same to the proximal portion 12*a* by soldering. Also, it may be mounted to the base 10 by a method such as crimping instead of embedding therein.

Although description has been made about the case in which the electric part with illumination of the invention is used for operating the side mirrors of the vehicle, it may be used for objects other then the vehicle.

In the electric part with illumination according to the first embodiment of the invention, since the illuminating member 11 is retained by the base 10 and then retained by the operating member 6, the illuminating member 11 can be mounted easily to the operating member 6. Even when the operating member 6 is moved, unevenness of illumination is not generated at the illuminating section 6*a*, and the illuminating section 6*a* can be illuminated efficiently, whereby the illuminating section 6*a* can be illuminated brightly, and hence the operability of the operating member 6 can be improved.

Also, since the illuminating member 11 is arranged with the connecting portion 12*b* provided on a surface of the base 10 opposing to the operating member 6, and the sliding strip is arranged on the opposite surface thereof, the front surface and the back surface of the base 10 can be effectively utilized, whereby the size of the electric part with illumination can be reduced.

Since the movable contacts 12 are formed integrally with the base 10, the number of components can be reduced. Since the movable contacts 12 include the proximal portions 12*a* formed with the connecting portions 12*b*, and the part of the proximal portions 12*a* is embedded in the base 10 and the portions exposed from the base 10 are used as the connecting portions 12*b*, the illuminating member 11 is connected to the connecting portions reliably by the surface mounting or the like, and the movable contacts 12 can easily be retained on the base. Since the operating member 6 and the base 10 are formed of different materials, by using a material which is superior in sliding property for the operating member 6 and a material which is superior in retaining strength for the base 10, the electric part with illumination which is superior in operability and superior in mechanical strength may be provided.

Since the base 10 is engaged with the operating member 6 by snap-fit so as not to be detached, it can be assembled easily. Also, since the movable contacts 12 are formed of a pair of the movable contacts 12 which are connected to the anode side and the cathode side of the illuminating member 11 and insulated from each other, and since the pair of the movable contacts 12 are formed by forming an integral member from the single metal plate, embedding the same in the base member 10, and cutting the cutting portions which connect the pair of the movable contacts 12, the base 10 and the movable contact 12 are integrated, and hence handling at the time of assembly is facilitated and the assembleability is further improved.

On the other hand, since the cutting portions 14 are formed on the proximal portions 12*a*, and the base 10 is formed with the cutting holes 10*b* which enables cutting of the cutting portions 14 after having embedded, the cutting portions 14 can be cut from the cutting holes 10*b*, and the pair of the movable contacts 12 can be reliably insulated.

Figure 5:
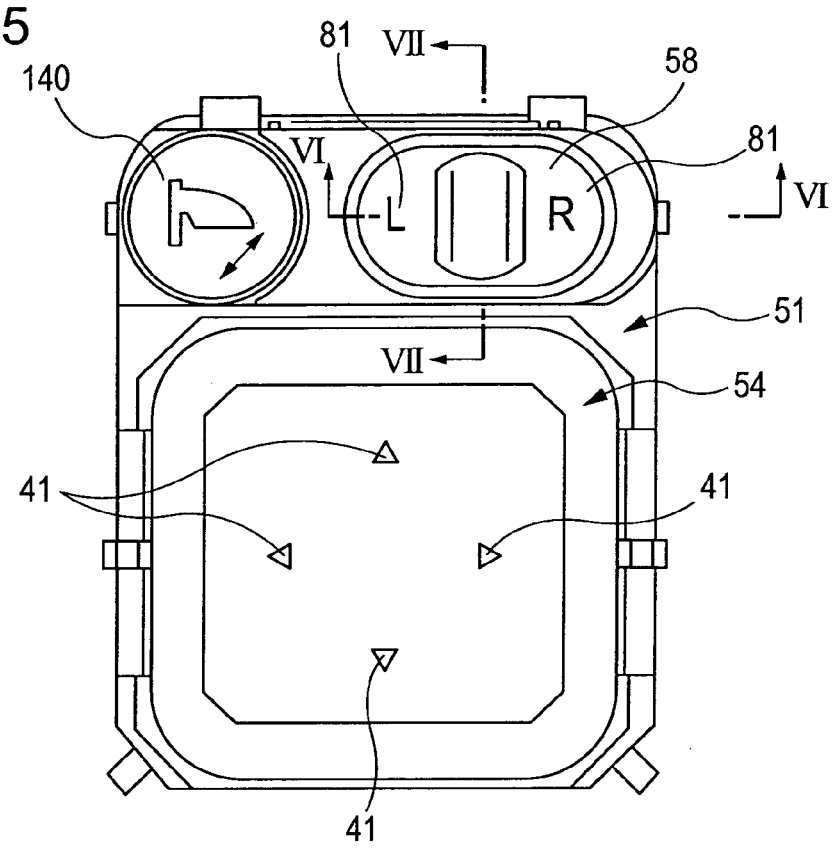
FIG. 5 is a plan view showing the slide-type electric part with illumination according to a second embodiment of the invention.
Figure 6:
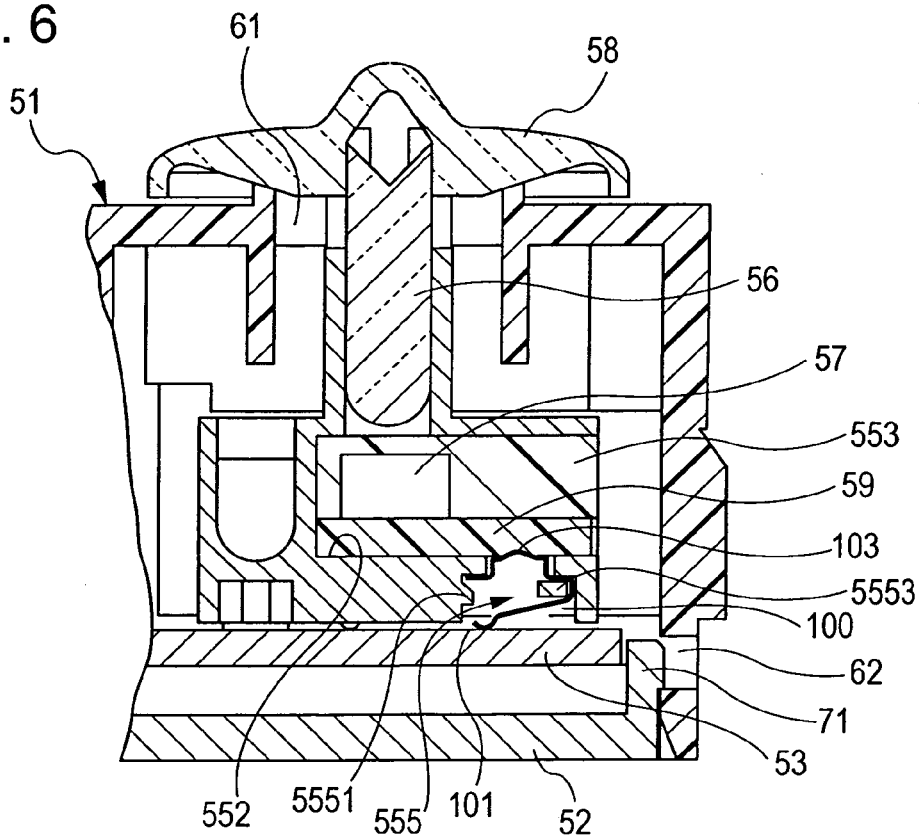
FIG. 6 is a cross-sectional view taken along a line VI—VI in FIG. 5.
Figure 7:
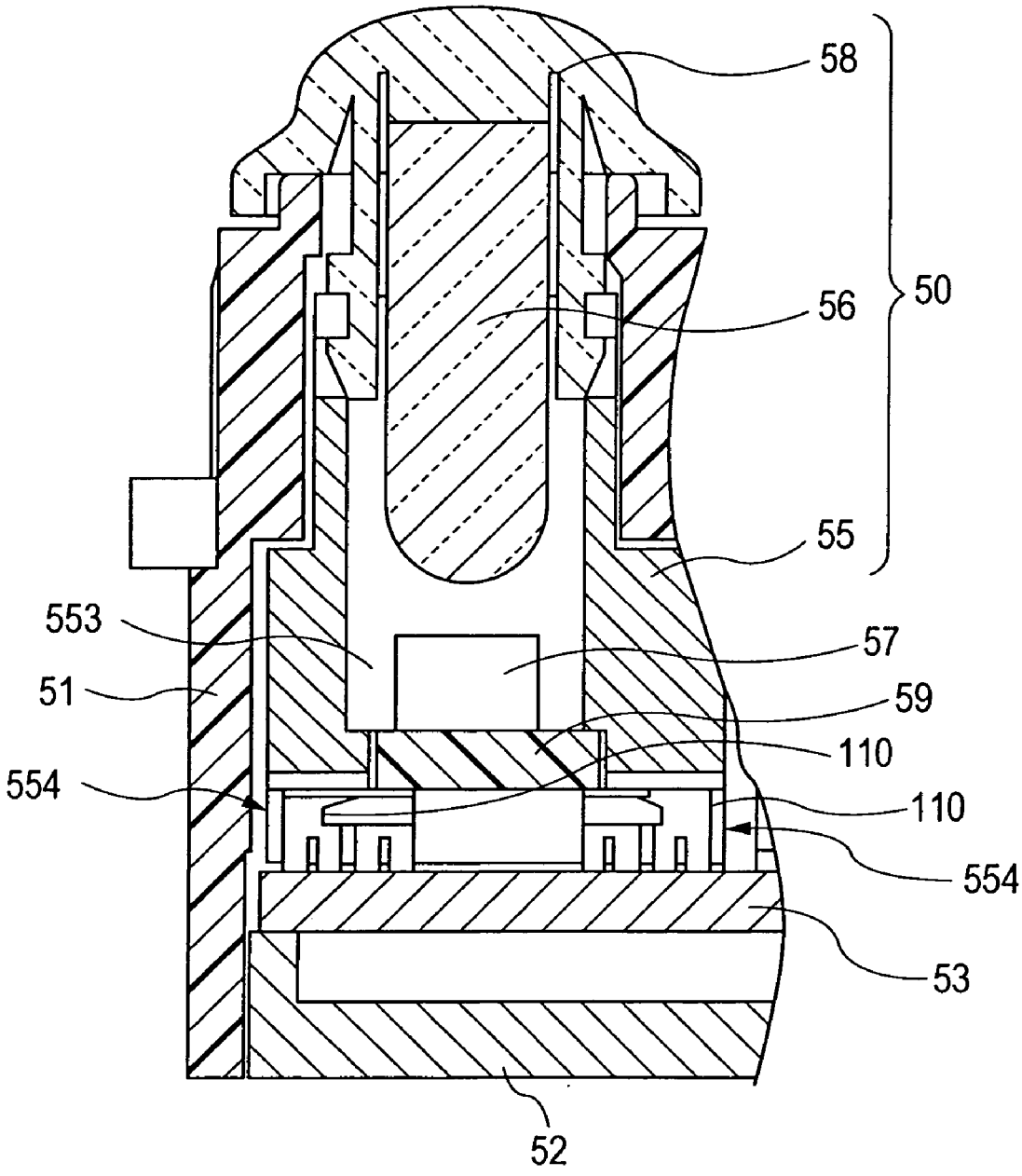
FIG. 7 is a cross-sectional view taken along a line VII—VII in FIG. 5.
Figure 8:
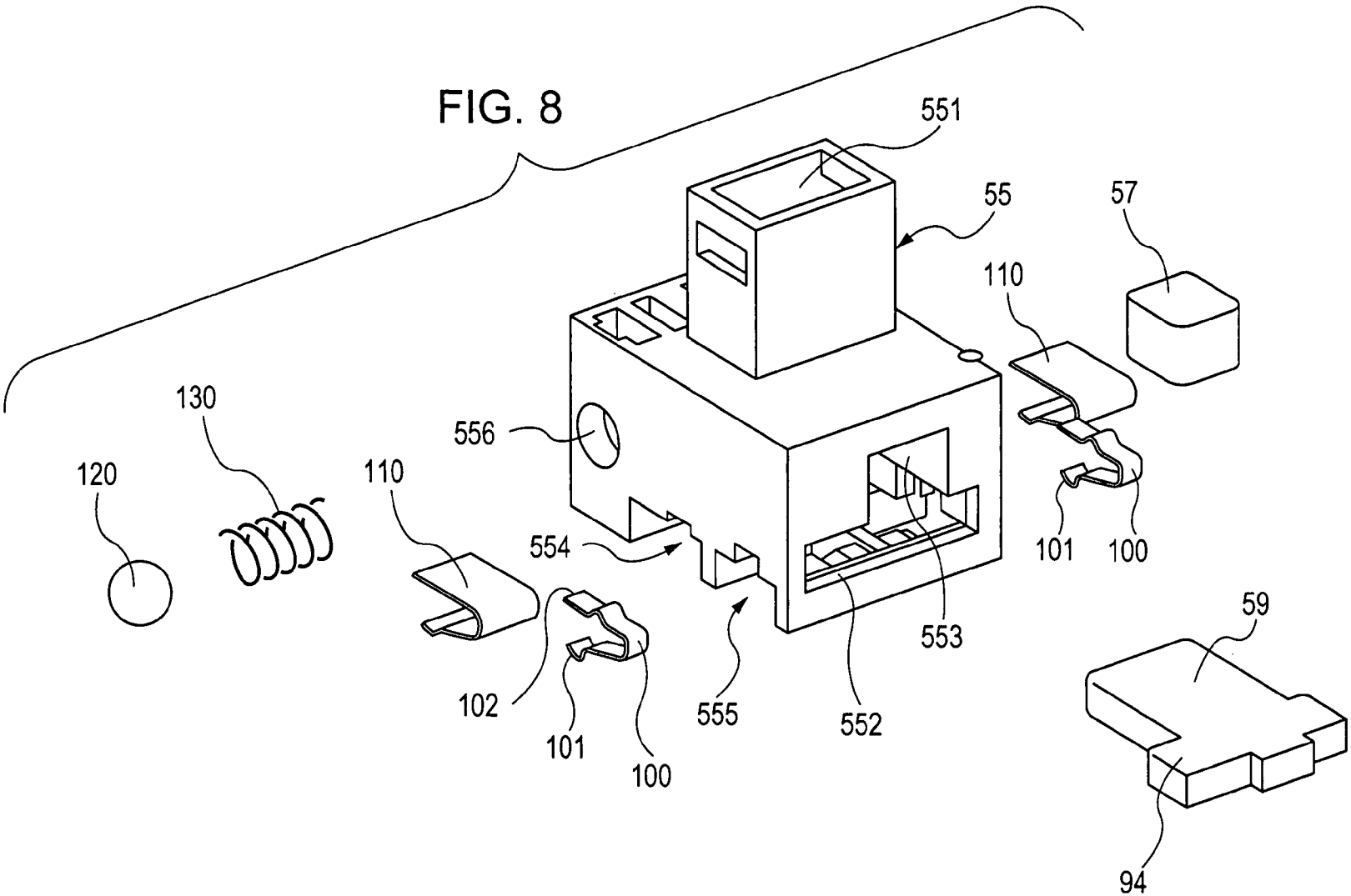
FIG. 8 is an exploded perspective view of the slide-type electric part with illumination shown in FIG. 5.
Figure 9:
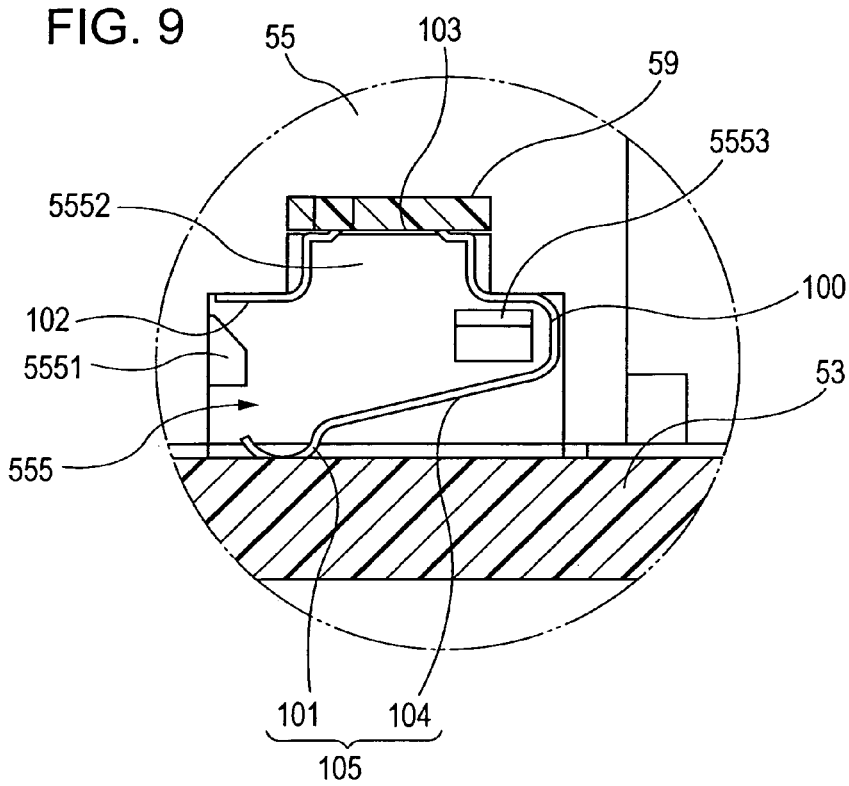
FIG. 9 is an enlarged view of a principal portion in FIG. 6.
Figure 10:
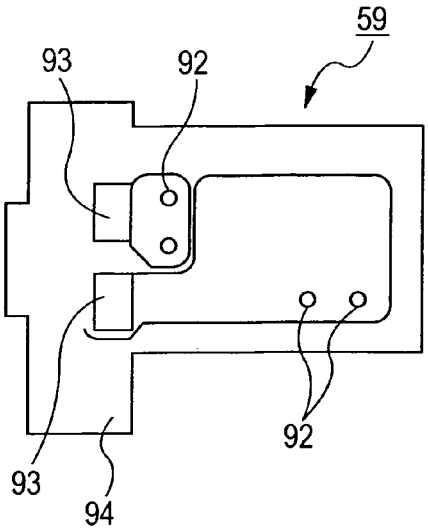
FIG. 10 is a plan view of a base shown in FIG. 8.
Figure 11:
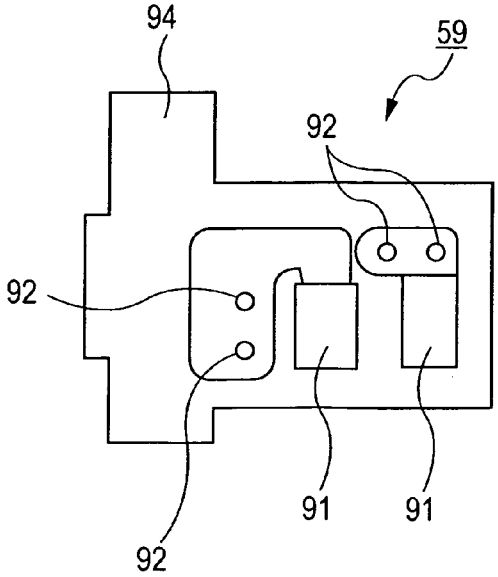
FIG. 11 is a bottom view of the base shown in FIG. 8.
Figure 12:
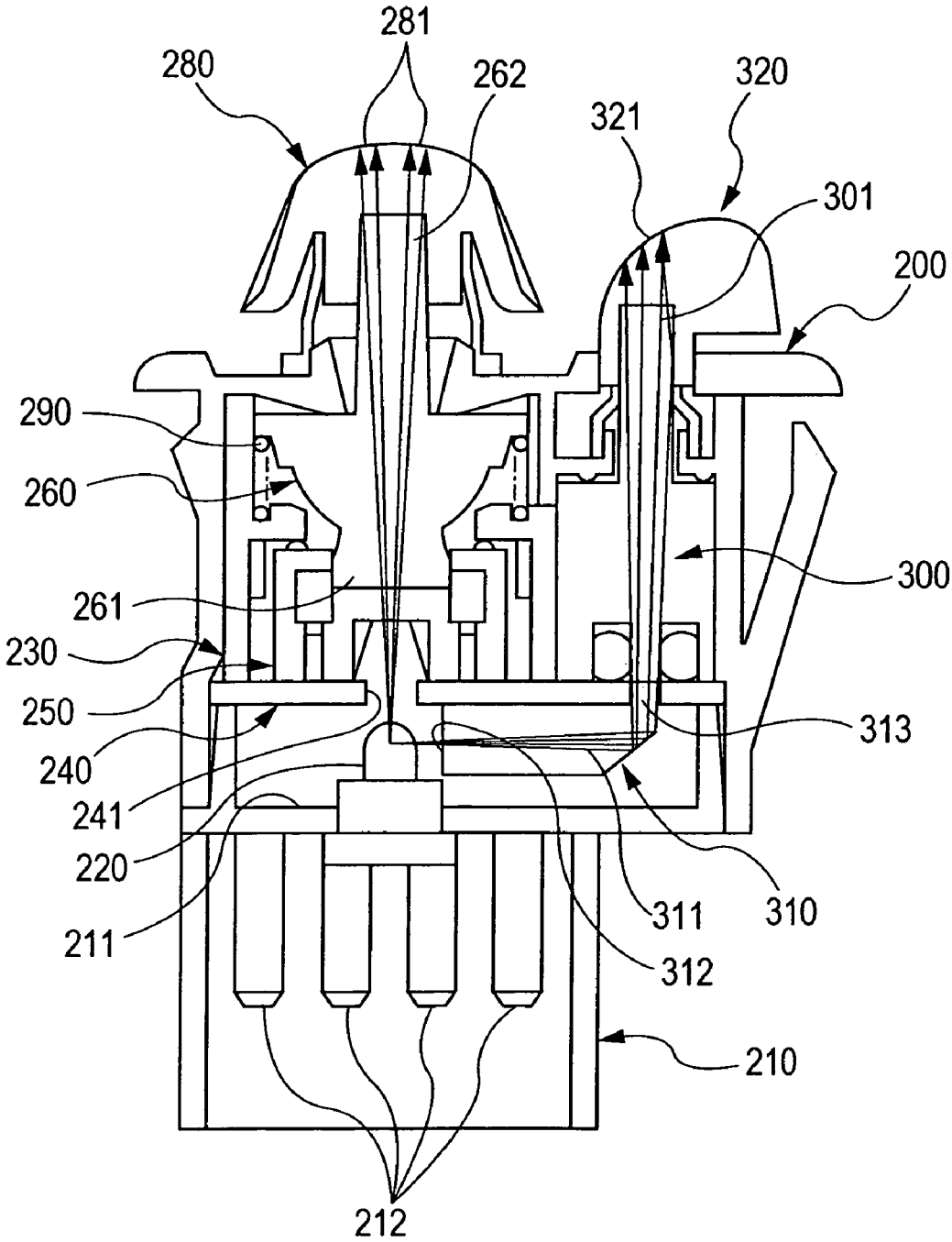
FIG. 12 PRIOR ART
FIG. 12 is a vertical cross-sectional view of the electric part with illumination in the prior art.
Figure 13:
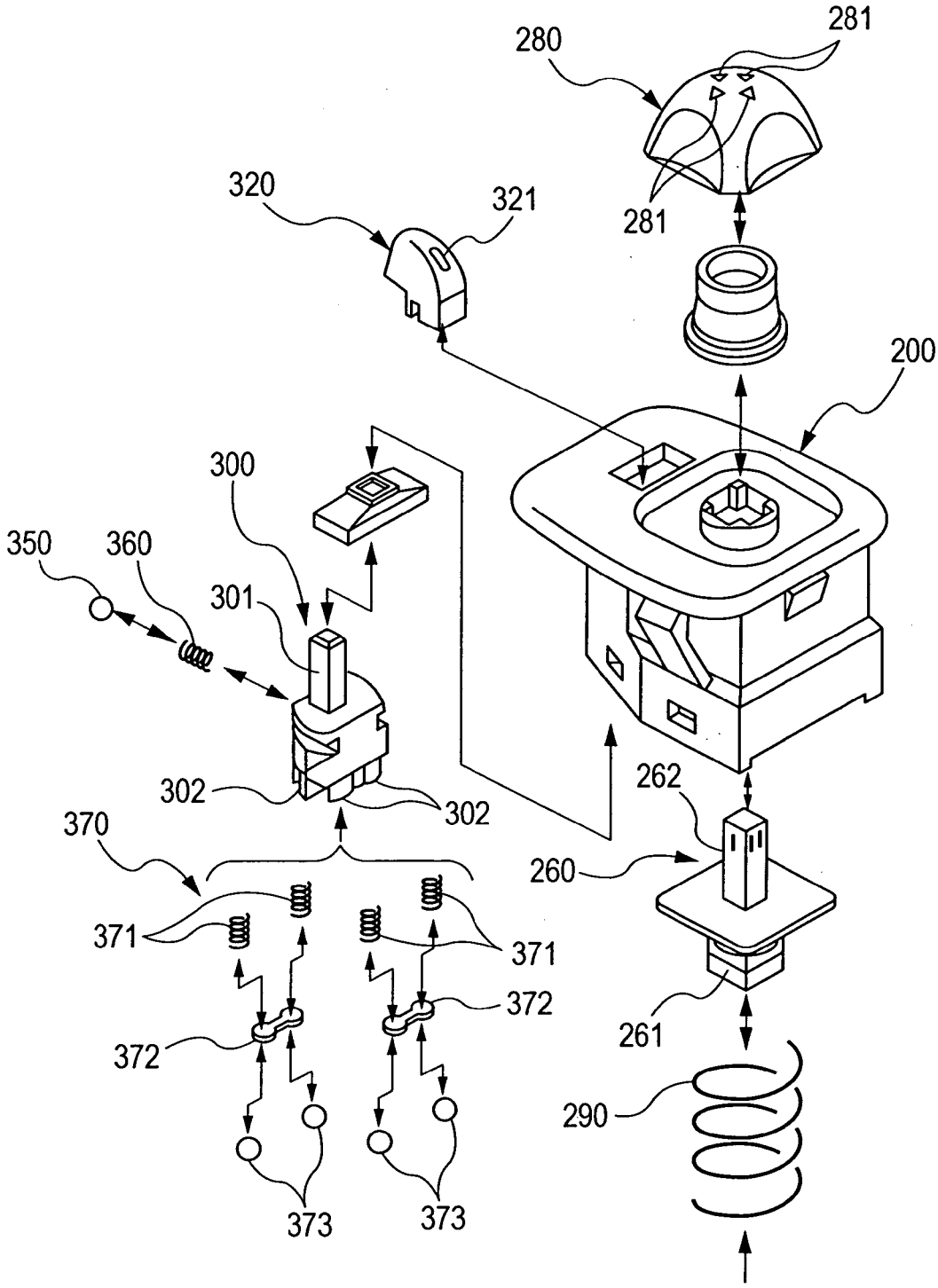
FIG. 13 PRIOR ART
FIG. 13 is an exploded perspective view of the slide-type electric part with illumination in FIG. 12.
Figure 14:
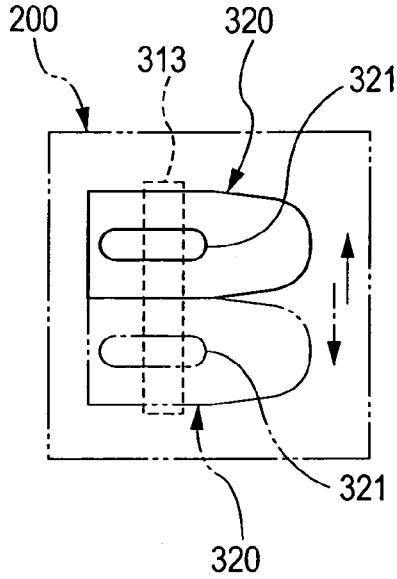
FIG. 14 PRIOR ART
FIG. 14 is a partial plan view showing a relative positional relation between the sliding state of the slide-type two-direction switch of a switching knob of the slide-type electric part with illumination in FIG. 12 and a light projecting member of a light guiding member.
Figure 15:
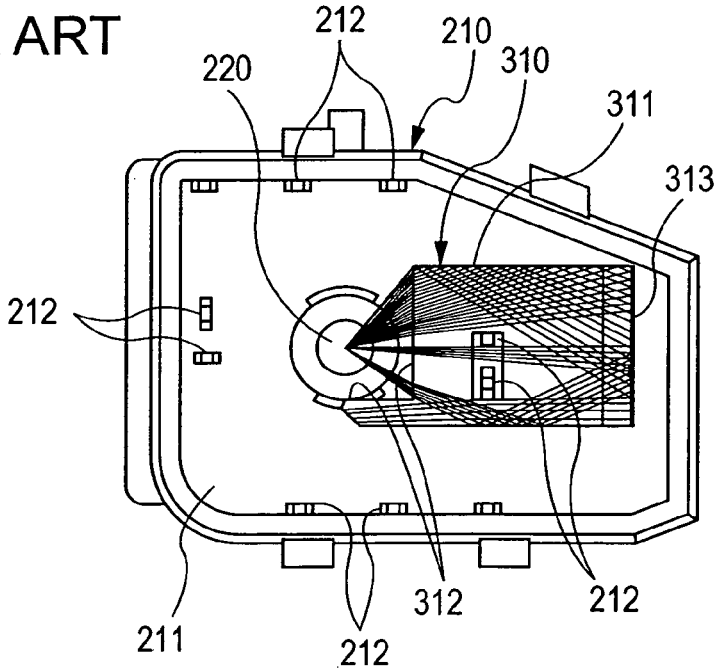
FIG. 15 PRIOR ART
FIG. 15 is an explanatory plan view showing a light path in the light guiding member of the slide-type electric part with illumination in FIG. 12.
Figure 16:
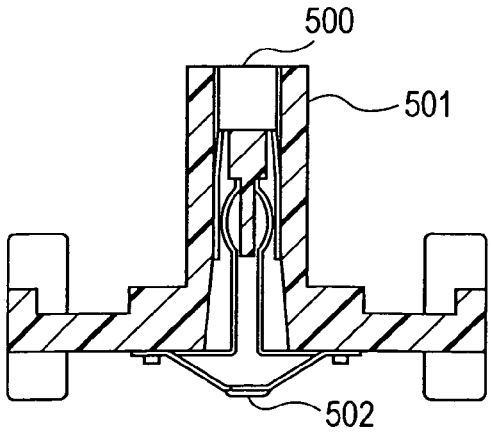
FIG. 16 PRIOR ART
FIG. 16 is a cross-sectional view showing another electric part with illumination in the prior art.

Subsequently, referring now to the drawings, a second embodiment of the invention will be described. FIG. 5 is a plan view showing an electric part with illumination according to the second embodiment of the invention; FIG. 6 is a cross-sectional view taken along a line 6—6 in FIG. 5; FIG. 7 is a cross-sectional view taken along the line 7—7 in FIG. 5; FIG. 8 is an exploded perspective view of the electric part with illumination shown in FIG. 5; FIG. 9 is an enlarged view of the principal portion of FIG. 6; FIG. 10 is a plan view of the base shown in FIG. 8; and FIG. 11 is a bottom view of the base shown in FIG. 8.

In FIG. 5 to FIG. 11, reference numeral 51 designates an upper case of the case. The upper case 51 is formed, for example, of synthetic resin, and has a hollow shape having an opening on a bottom thereof. A square through hole (not shown) is formed at substantially the center of an upper surface of an upper portion of the upper case 51, and a guide portion (not shown) for guiding an actuator (not shown) in four directions is provided on an inner peripheral surface of the through hole. At one end side of the upper portion of the upper case 51 is provided with a rectangular through hole 61, and at one end side of the upper portion of the upper case 51 is provided with a circular through hole (not shown), where a left and right mirror opening/closing button 140 is mounted.

Lower portions of two side walls of the upper case 51 opposing to each other, rectangular engaging holes 62 are provided.

Reference numeral 52 designates a lower case (or a holder) of the case. The lower case 52 is formed, for example, of synthetic resin, and is slightly smaller than an opening at the bottom of the upper case 51 and having a recess on the upper surface thereof. The two side portions of the lower case 52 opposing to each other are integrally formed with rectangular engaging projections 71 corresponding to the engaging holes 62 of the upper case 51. The lower case 52 is press-fitted into the bottom opening of the upper case 51, and the engaging projections 71 of the lower case 52 engage the engaging holes 62 of the upper case 51, whereby the upper case 51 and the lower case 52 are integrally assembled.

A circuit board (fixed portion) 53 is provided on an upper portion of the lower case 52. The circuit board 53 is formed, for example, of a printed circuit board (P.C.B). An upper surface of the circuit board 53 is provided with left/right switching patterns which output signals corresponding to the position of marks 81 (illuminating sections) of L and R, described later, formed of electrically-conductive conductor and disposed at a predetermined distance in the sliding direction, and power feed patterns on which LED-flickering movable contacts 100 slide over the entire area of the movement of a switching knob 58, described later, by printing. The circuit board 53 is fixed in the upper case 51 between a lower end of the upper case 51 and an upper surface of the peripheral edge of the upper surface opening of the lower case 52.

Reference numeral 54 designates a switching knob of the four-direction switch. The four-direction switching knob 54 is fixedly fitted to an upper end of a shaft portion of the actuator. The four-direction switching knob 54 is formed of, for example, light transmitting synthetic resin (acrylate resin (PMMA: polymethylmethacrylate)) and formed into a quadrangular pyramid shape. Light transmitting marks 41 are provided respectively at four positions in four directions in which the four-direction switching knob 54 is operated for switching. The light transmitting marks 41 are formed by applying opaque coating at portions on an outer surface of the four-direction switching knob 54 other than the marks 41, and are adapted to be illuminated by light from a light source, not shown, fixed on the case.

Reference numeral 50 designates an operating member of the two-direction switch, which has the switching knob 58, a slider 55, and a light guiding member 56.

Reference numeral 55 designates the slider for the two-direction switch. The two-direction slider 55 is formed, for example, of transparent synthetic resin (transparent acrylic resin), into substantially a block shape. A retaining portion 551 in the form of a square tube is provided substantially at the center of an upper surface of the two-direction slider 55 so as to project upward in the vertical direction. The light guiding member 56 is fitted to the retaining portion 551, and the light guiding member 56 has a rectangular parallelepiped shape which matches the through hole in the retaining portion 551 with lower surface formed into a semi-circular shape in cross-section and opposed to a light source (illuminating member) 57. The upper end of the light guiding member 56 is formed with a reflecting surface of substantially V-shape which is depressed into a triangular shape, so that light from the light source 57 is reflected thereon and guided into the switching knob 58 fixedly fitted to the upper end portion thereof.

Provided on one side surface of the two-direction slider 55 are insertion portion 552 for inserting, storing and retaining a base 59 and a second insertion portion 553 which is continued from the insertion portion 552 for storing the light source 57 mounted on the base 59. The second insertion portion 553 communicates with the through hole on the retaining portion 551, so that light from the light source 57 passes through the light guiding member 56 in the retaining portion 551 to illuminate the marks 81 on the switching knob 58.

The two-direction slider 55 is formed with recesses 554 on both sides of the lower surface thereof, and a LR (left and right)-switching movable contacts 110 are stored in the recesses 554. The LR (left and right)-switching movable contacts 110 each are formed by bending a plate-shaped electrically conductive plate, and the lower end thereof slides on the switch pattern on the circuit board 53 located below.

The two-direction slider 55 is formed with second recesses 555 (storages) on both side of the lower surface thereof, and the LED-flickering movable contacts 100 are stored in the second recesses 555. The second recesses 555 each include an engaging portion 5551 formed so as to be projected from an upper portion of one side surface thereof, with which an engaging portion 102 at the upper extremity of the LED-flickering movable contact 100 engages, an opening 5552 which communicates with the insertion portion 552 for storing the base 59, and a projection 5553 provided near the upper portion on one side surface and forming clearances with respect to the upper surface and the side surface. As described above, the second recesses 555 communicate with the insertion portion 552 via the openings 5552, and the lower surface of the base 59 is exposed from the opening 5552 into the second recess 555.

The LED-flickering movable contact 100 is formed by bending a plated-shaped electrically conductive plate, whereby the contact point 101 at a lower end of a lower plate portion slides on the power feed patterns on the circuit board 53 located below. A bent upper plate portion includes an engaging portion 102 which engages the engaging portion 5551 at a distal end thereof, and a connecting portion 103 formed by bending the center portion of the upper plate portion upward in a stepped manner. As shown in FIG. 9, when the LED-flickering movable contact 100 is pushed, inserted and fitted into the slider 55 through the clearance therearound with the engaging portion 102 engaged with the engaging portion 5551, and the crank-shaped portion of the bent portion thereof abutted against a tapered surface of the projection 5553, the connecting portion 103 is advanced into the storage 553 and hence mounted thereto. Subsequently, the connecting portion 103 of the LED-flickering movable contact 100 is brought into press-contact with the lower surface of the base 59 which is inserted into the insertion portion 552. Therefore, the connecting portion 103 of the LED-flickering movable contact 100 stored in the second recess 555 is connected to the connecting portion 92 of the circuit pattern on the base 59 which is inserted into the insertion portion 552. In this case, since the base 59 is inserted from the root side of the resilient arm 104 of the LED-flickering movable contact 100 and hence deflects the same, undesirable deformation does not occur.

The resilient arm 104 and the contact portion 101 forms the sliding strip 105 which comes into sliding contact with the power feed patterns.

On one side surface of the two-direction slider 55 extending along the sliding direction is formed with a circular storage 556 for accommodating a ball 120 and a spring 130 as a switching mechanism, described later.

The two-direction slider 55 is arranged in the upper case 51 between the upper case 51 and the upper surface of the circuit board 53 so as to be capable of sliding in the linear direction. The retaining portion 551 of the two-direction slider 55 passes through the rectangular through hole 61 of the upper case 51 and projects outside of the upper case 51.

Reference numeral 56 designates the light guiding member. The light guiding member 56 has, for example, a heat resistant property, and is formed of transparent light-transmitting synthetic resin (acrylic resin) for causing light from the light source 57 to illuminate the marks 81 on the two-direction switching knob 58 via the retaining portion 551 of the two-direction slider 55.

Reference numeral 58 designates the switching knob of the two-direction switch. The two-direction switching knob 58 is formed, for example, of light-transmitting synthetic resin (acrylic resin (PMMA: polymethylmethacrylate)). The two-direction switching knob 58 is fixedly fitted to an upper end of the retaining portion 551 of the two-direction slider 55. Light-transmitting marks 81 are provided respectively near both ends of the surface of the two-direction switching knob 58. The light-transmitting L an R marks 81 are formed by applying opaque coating on a portion of the outer surface of the two-direction switching knob 58 other than the marks 81. Alternatively, the two-direction switching knob 58 is formed by two colors molding with light-transmitting synthetic resin for the portion corresponding to the marks 81 and with opaque synthetic resin for other portion. In other words, it is adapted in such a manner that light from the light source 57 built in the two-direction slider 55 is guided through the light-conducting member 56, so that the marks 81 are illuminated.

Reference numeral 59 designates the base, which is formed with two land portions 91 on which the light source 57 is placed and soldered on the surface thereof as shown in FIG. 10, and the surfaces other than the land portions 91 are coated with resist. Reference numeral 92 designates a through-hole for connecting to the pattern on the back surface. The back surface of the base 59 is formed with connecting portions 93 with which the connecting portion 103 of the LED-flickering movable contacts 100 come into press-contact and electrically connected respectively. The back surface is coated with resist over the portion other than the connecting portion 93.

Reference numerals 120 and 130 designate the ball and the spring as a switching mechanism. The spring 130 is stored in the storage 556 on one side surface of the two-direction slider 55 in a compressed state, while the ball 120 is provided between the spring 130 in the compressed state and a switching groove (not shown) provided on the inner surface of the upper case 1. The switching groove includes a V-shaped trough (not shown) at the center, first and second crests (not shown) on both sides of the V-shape trough, and a first bevel (not shown) and a second bevel (not shown) extending from the first crest and the second crest. On the other hand, the ball 120 is pressed against the switching groove by the spring 130. Then, in the switching mechanism, when the ball 120 is positioned in the V-shaped trough, the two-direction slider 55 is positioned at the neutral position, and when the ball 120 is positioned at the first bevel, the two-direction slider 55 is located at the first position (for example, the position L) and when the ball 120 is positioned at the second bevel, the two-direction slider 55 is positioned at the second position (for example, the position R). The switching mechanism retains a state in which the two-direction switching knob 58 and the two-direction slider 55 are positioned at the neutral position, the first position, and the second position, and provides a tactile feedback of switching operation of the two-direction switching knob 58 and the two-direction slider 55.

The electric part with illumination of the invention in this embodiment is configured as described above. The assembly of the principal portion will be described below.

As shown in FIG. 9, when the LED-flickering movable contact 100 is pushed, inserted, and fitted into the slider 55 through the clearance therearound with the engaging portion 102 of the LED-flickering movable contact 100 engaged with the engaging portion 5551, and the crank-shaped portion of the bent portion thereof abutted against the tapered surface of the projecting portion 5553, the connecting portion 103 is advanced into the second recess 555 and hence mounted thereto. On the other hand, the base 59 with the light source 57 formed of a chip LED having no lead wire surface mounted on the surface thereof by a reflow soldering process is provided, is oriented so that the back surface thereof opposes the connecting portions 103 of the LED-flickering movable contacts 100, and are moved along the guide portion from the entrance end of the insertion portion 552 provided on the side surface of the slider 55 toward the inside. Then, the contact portion 103 of the LED-flickering movable contact 100 is brought into press-contact with the lower surface of the base 59 which is inserted into the second recess 555. Therefore, the connecting portion 103 of the LED-flickering movable contact 100 stored in the second recess 555 is connected to the connecting portion 92 of the circuit pattern on the base 59 inserted into the second recess 555. Simultaneously, the base 59 is prevented from moving in the used state by resiliency of the connecting portion 103.

Subsequently, the operation thereof will be described.

In the operation of the two-direction switch, when the two-direction switching knob 58 located as the neutral position shown in FIG. 2 is moved leftward or rightward, the moving force of the two-direction switching knob 58 is transmitted to the two-direction slider 55, and the two-direction slider 55 also slides in the same direction between the upper case 51 and the circuit substrate 53. Then, the two-direction slider 55 is positioned at the first position or the second position, and in association with it, the ball 120 located at the V-shaped trough moves downward once against a spring force of the spring 1, climbs over the first crest or the second crest, and is positioned on the first bevel or the second bevel. When the ball 120 climbs over the crest and drops into the trough, the tactile feedback is provided. In association with sliding movement of the above-described two-direction slider 55, the LED-flickering movable contacts 100 and the LR-switching movable contacts 110 slide on the circuit board 53 in the same direction, so that the LR-switching patterns with which the LR-switching movable contacts 110 are in contact is switched between the first circuit and the second circuit.

Subsequently, when the two-direction switching knob 58 positioned in the first position and the second position is moved to the neutral position, the two-direction slider 55 slides from the first position or the second position to the neutral position, and in association with it, the ball 120 climbs from the first bevel or the second bevel over the first crest or the second crest and positions in the V-shaped trough, while the two-direction LED-flickering movable contacts 100 and the LR-switching movable contacts 110 slide in the same direction and are switched to the neutral state in which the LR-switching movable contacts 110 switched to the first circuit or the second circuit are not in contact with any of the switching patterns. The LED-flickering movable contacts 100 slides on the power feed pattern of the circuit board 53 while being constantly in contact therewith by the sliding movement described above, and power is constantly fed from the power feed pattern through the contact portion 101 of the LED-flickering movable contact 100 and then through the connecting portion 93 of the base 59 which is connected to the connecting portion 103, and then from the through hole 92 to the light source 57 connected to the land portions 91, the L and R marks 81 are constantly illuminated.

Since the procedure for driving the mirror by the operation of a two-direction switching knob 589 and the four-direction switching knob 54 is the same as the aforementioned first embodiment, description is omitted.

According to the electric part with illumination of the second embodiment of the invention, when the light source 57 built in the two-direction slider 55 is illuminated by feeding power by the LED-flickering movable contacts 100 which slide on the circuit board 53 when the two-direction slider 55 is slid, the light source 57 can be illuminated irrespective of the slid position of the two-direction slider 55. The light of the light source 57 illuminates the marks 81 on the two-direction switching knob 58 via the light guiding member 56 opposing the light source 57. Consequently, since the marks 81 of the two-direction switching knob 58 are constantly illuminated, the possibility of erroneous switching operation is eliminated.

The invention is not limited to the second embodiment described above, for example, it is possible to mount the light source (LED) into the base after having inserted the base into the two-direction slider. Alternatively, it is possible to insert the base on which the light source is mounted into the two-direction slider, and then the LED-flickering movable contacts built in the recesses are soldered on the patterns on the back surface of the base, or it is also possible to mount the light source to the base and make the base to retain the LED-flickering movable contacts thereon and solder the same.

In the second embodiment configured as described above, since there are provided the slidably retained two-direction slider 55, the light source 57 retained so as to move integrally with the two-direction slider 55, the circuit board 53 provided with the power feed pattern, the connecting portion 103 moving integrally with the two-direction slider 55 and connected to the light source 57, the LED-flickering movable contact 100 having the contact portion 101 sliding on the power feed pattern, and the base 59 retaining the light source 57 and retained by the two-direction slider 55, then the conductive pattern which connects between the portion of the base 59 retaining the light source 57 and the connecting portion 103 with respect to the LED-flickering movable contact 100 is provided on the base 59, and then the light source 57 and the LED-flickering movable contact 100 are electrically connected, the light source 57 can be mounted to the two-direction slider 55 easily, and unevenness of illumination does not occur even though the two-direction slider 55 is moved.

In the second embodiment, since the LED-flickering movable contact 100 is retained by inserting the second recess 555 provided on the two-direction slider 55, and the insertion portion 552 for allowing the base 59 to be inserted is provided on the side surface of the two-direction slider 55 extending in the direction orthogonal to the insertion direction of the LED-flickering movable contact 100, the base 59 retaining the light source 57 and the LED-flickering movable contact 100 are retained easily on the two-direction slider 55, and electrical connection between the LED-flickering movable contact 100 and the base 59 can be achieved without soldering.

In other words, according to the electric part with illumination of the second embodiment, since the illumination member 57 is retained on the base 59 and then the base is retained by the operating member 50 as in the first embodiment, the illuminating member 57 is easily mounted to the operating member 50. Since unevenness of illumination of the illuminating sections 81 is not generated even when the operating member 50 is moved and the illuminating section 81 can be illuminated efficiently, the illuminating section 81 can be illuminated brightly, and hence the operability of the operating member 50 can be improved.

Also, since the illuminating member 57 is arranged on the one surface of the base 59 which opposes the operating member 50 and the sliding strip 105 is arranged on the opposite surface, the front surface and the back surface of the base 59 can be used effectively, and hence the size of the electric part with illumination can be reduced.

In the second embodiment, the base 59 is formed with the conductive pattern for connecting the land portions 91 connected to the illuminating member 57 and the connecting portion 103 with respect to the movable contacts 100, the illumination member 57 and the movable contacts 100 are electrically connected, and the conductive pattern and the movable contacts 100 are in resilient contact. Therefore the circuit board can be used as the base 59 and the conductive pattern and the movable contacts 100 can be connected without soldering.

Also, the movable contacts 100 are inserted and retained in the storage 555 provided in the operating member 50, and the insertion portion 552 is formed on the side surface of the operating member 50 extending orthogonally to the inserting direction of the movable contacts 100 for allowing the base 59 to be inserted therein. Therefore, the base 59 retaining the illuminating member 57 and the movable contact 100 can be retained easily in the operating member 50, and simultaneously, electrical connection between the movable contact 100 and the conductive pattern is achieved.

What is claimed is:

1. An electric part with illumination comprising:

an operating member being movably retained and having an illuminating section thereon;

an illuminating member moving integrally with the operating member and illuminating the illuminating section;

a fixed portion having power feed patterns which can feed power to the light illuminating member;

a movable contact moving integrally with the operating member and having a sliding strip, the sliding strip having a connecting portion to be electrically connected to an electrode of the illuminating member and a contact point sliding on the power feed patterns; and a base retaining the illuminating member and being retained by the operating member.

2. The electric part with illumination according to claim 1, wherein the illuminating member is disposed on a surface of the base opposing the operating member and the sliding strip is disposed on the opposite surface thereof.

3. The electric part with illumination according to claim 2, wherein the base is formed with a conductive pattern which connects a portion retaining the illuminating member and the connecting portion with respect to the movable contacts, the illuminating member and the movable point are electrically connected, and the conductive pattern and the movable contacts are brought into resilient contact.

4. The electric part with illumination according to claim 3, wherein the movable contact is inserted and retained in a storage provided on the operating member, and an insertion portion is formed on a side surface of the operating member extending in a direction orthogonal to an inserting direction of the movable contacts for allowing the base to be inserted therein.

5. The electric part with illumination according to claim 1, wherein the movable contact is integrally formed on the base.

6. The electric part with illumination according to claim 5, wherein the movable contact includes a proximal portion formed with the connecting portion, and part of the proximal portion thereof is embedded in the base, and portion exposed from the base is used as the connecting portion.

7. The electric part with illumination according to claim 6, wherein the movable contact includes a pair of movable contacts connected to an anode side and a cathode side of the electrode of the illuminating member and insulated from each other and the pair of the movable contacts are integrally formed from a single metal sheet by embedding in the base and then cutting a cutting portion which connects the pair of the movable contacts.

8. The electric part with illumination according to claim 7, wherein the proximal portion is formed with the cutting portion, and the base is formed with a cutting hole which enables cutting of the cutting portion after having embedded.

9. The electric part with illumination according to claim 5, wherein the operating member and the base are formed of different materials.

10. The electric part with illumination according to claim 5, wherein the base is snap-fitted to the operating member so as to be disconnected therefrom.

* * * * *